United States Patent [19]

Vidal

[11] 4,125,970

[45] Nov. 21, 1978

[54] BULK STORAGE FACILITY

[76] Inventor: Henri C. Vidal, 8 bis Boulevard Maillot, Neuilly (92), France

[21] Appl. No.: 802,446

[22] Filed: Jun. 1, 1977

[51] Int. Cl.[2] ..... E02D 5/20; E04H 7/26

[52] U.S. Cl. ..... 52/31; 52/169.4; 52/169.7; 52/197; 52/742; 214/17 DC; 405/284

[58] Field of Search ..... 52/169.7, 169.1, 169.4, 52/197, 742; 214/17 DA, 17 DC; 61/39, 49

[56] References Cited

U.S. PATENT DOCUMENTS

| | | | |
|---|---|---|---|
| 3,191,783 | 6/1965 | Henderson | 214/17 DC |
| 3,486,282 | 12/1969 | Moriarity | 52/197 X |
| 3,686,873 | 8/1972 | Vidal | 61/39 |
| 3,889,826 | 6/1975 | Pate | 214/17 DA |
| 3,953,979 | 5/1976 | Kurose | 61/39 |
| 4,038,795 | 8/1977 | Abrams | 52/169.7 |

FOREIGN PATENT DOCUMENTS

| | | | |
|---|---|---|---|
| 747,703 | 4/1933 | France | 61/49 |
| 528,864 | 6/1957 | Italy | 52/197 |
| 147,298 | 7/1920 | United Kingdom | 52/197 |

*Primary Examiner*—Alfred C. Perham
*Attorney, Agent, or Firm*—Burns, Doane, Swecker & Mathis

[57] ABSTRACT

A bulk storage facility for pulverulent friable or fungible material, such as coal, is disclosed having a slot defined by downwardly convergent inclined walls each of which are fabricated from a plurality of wall panels. The wall panels are the facing for a coherent mass that includes a multiplicity of thin flexible reinforcing strips that are each surrounded by particulate material. Each wall panel has an inclined surface which defines an angle with respect to a horizontal plane that exceeds the angle of repose of material to be stored in the bulk storage facility. In addition, each wall panel may be provided with a pair of gussets which extend into the particulate material positioned therebehind. Several flexible metal reinforcing strips may be attached in vertically spaced relation to each of the gussets. Each edge surface of the wall panel has a tongue and an adjacent rabbet such that, when the panels are assembled in a wall, adjacent panels interlock to restrain the panels against rotation about horizontal and vertical axes. The method of construction includes building the inclined walls by laying a first course of panels, backfilling the panels with a layer of particulate material, attaching a generally horizontal planar array of reinforcing strips to the panels, covering the planar array with a lift of particulate material; repeating the attaching and covering steps until the first course of panels is completely backfilled, placing a second course of panels on the first course with sealant material therebetween, repeating the procedure for backfilling and placing additional courses with backfilling until the wall is completed.

17 Claims, 12 Drawing Figures

29
31
25
34
130
23
22
36
74
62'
76
38
70
2
2
64
24
62
72
21
20
130
23'
28

BULK STORAGE FACILITY

BACKGROUND OF THE INVENTION

This invention relates generally to bulk storage facility for pulverulent, friable, granular or fungible material such as coal, mineral ore, grain or the like. In particular, this invention concerns a bulk storage facility in which a material storage slot, defined by a pair of convergent inclined walls, has interlocking facing panels which cover internally stabilized earth walls.

A typical bulk storage facility includes a material storage slot defined by generally planar inclined walls which are convergent toward a longitudinal opening at the bottom. The longitudinal opening communicates with a reclaim tunnel running longitudinally of the storage slot below the longitudinal opening. A pair of endwalls, either vertical or inclined, complete the definition of the storage slot. The endwalls extend between the inclined walls.

To protect the bulk material being stored from environmental moisture, a roof typically covers the storage slot. The roof is often A-shaped in cross section with a suitable conventional tripper conveyor extending longitudinally of the roof at the apex thereof. Bulk material is introduced into the storage slot with the tripper conveyor and is removed from the storage slot by a reclaim conveyor positioned in the reclaim tunnel.

In the past, bulk storage facilities have been used, for example, in the storage of coal since the bulk storage facility is particularly well adapted for use near coal mining operations such as those in the Western United States were sub-bituminous coal is mined. Since sub-bituminous coal does not have a reliable energy rating (as BTU available per pound of material), it is desirable to blend the coal after mining and before use. In a typical bulk storage facility, material is stocked horizontally and removed vertically so that blending occurs. Thus, the desirable blending of sub-bituminous grades of coal is conveniently effected.

The desired location for a bulk storage facility has an influential effect on basic design considerations. For example, where the local terrain is flat, the storage slot may be constructed either by excavation below the existing ground surface or by building parallel dikes above the existing ground surface. In rugged terrain, the storage slot is often constructed adjacent to a convenient hillside by extending the hillside to define one inclined wall of the slot and by building a parallel dike to define the second inclined wall.

Within the bulk storage facility, the inclined walls of the storage slot are inclined relative to horizontal by an angle which exceeds the classical angle of repose for the bulk material to be stored so that there are no dead areas from which material does not discharge.

In the past, where the angle of the inclined walls was low, i.e., less than 45°, the conventional construction method was to compact the slope material and then trim the inclined slope to the proper surface shape. Trimming was typically effected by a bulldozer with a tilting blade or by a drag line. Once the slope surface was prepared by trimming, a facing was applied in one of several alternative manners: placing precast concrete panels; in situ casting of concrete facing slabs; or, recently, by spraying a gunite facing.

When the angle of the inclined walls is comparatively high, e.g. 45° or greater, the compacted slope material has marginal stability. Accordingly, more complex construction techniques were required. For example, a facing of cement stabilized or lime stabilized material was positioned adjacent the storage slot so as to extend in the neighborhood of fifteen feet away from the surface toward the compacted material. The stabilized zone was placed as each layer of the associated dike or hillside extension was deposited and compacted.

The large size of a bulk storage facility in combination with the vagaries of construction techniques cause contractors to overbuild the stabilized zone into the storage slot so that the proper lateral depth for the stabilized zone is ensured. The overbuilt portion then was trimmed to the proper inclination before a facing was applied; however, while the cement or lime stabilization stabilized the inclined slope, it also was hard to cut during the subsequent trimming operation. Moreover, the stabilization technique was expensive due to the additional material, i.e., cement or lime, that was required and was very time consuming.

After the compacted slope material was stabilized, the trimming operation began at the top of the inclined wall by cutting the stabilized zone to proper grade for a selected depth, or bench. Then, welding wire reinforcing fabric was applied and a gunite facing was subsequently applied. Then, another lower bench was shaped and faced and so on until the wall was finished. Some contractors elected, as an alternative, to cut the entire slope surface before applying the reinforcing fabric and gunite.

With inclined walls having either high or low angles, the reclaim conveyor tunnel was generally built first. Then, the tunnel was filled with earthen material before the inclined walls were built. In fact, during conventional construction of the storage facility, an enormous quantity of earthen material was placed in the storage slot to facilitate construction which material was later removed before the facility was complete. The presence of this earthen material precluded any work on installation of the reclaim conveyor in the reclaim tunnel until the inclined walls had been completed. It is noted also that during trimming operations discussed above, the trimmed material often dropped into the then untrimmed portion of the storage slot.

In addition to the problems discussed above, the construction of a bulk storage facility heretofore has been plagued with other problems. For example, the overburden material often present at existing sites for bulk storage facilities and used for the earthen dikes is not always well-suited for cement or lime stabilization. Sometimes, the amount of cement or lime required for stabilization cannot be predicted with any meaningful degree of certainty. Thus, the cost of additional stabilizing material cannot be realistically estimated.

Moreover, since trimming of the inclined slopes is generally performed by construction equipment, such as bulldozer, the trimmed surface is not highly uniform. As a result the quantity of gunite material that needs to be applied is difficult to evaluate. In this connection, cost overruns for gunite material alone frequently run in the vicinity of 50 to 100%.

Furthermore, with respect to the gunite facing, the quality of the surface is a strong function of nozzle orientation relative to the surface: the best surface results from the nozzle being normal to the surface. Thus, the day-to-day attitude of workmen applying the surface can affect surface quality.

With the existing construction techniques, as much as a year may be required to complete construction of a storage facility. When climatic conditions require a cessation of construction activities, e.g., during winter the surface water erosion of prepared slope surfaces can require repair of those surfaces before construction continues, further delaying construction completion.

Accordingly, it is apparent that there exists a need for an economical, practical method and apparatus for constructing inclined slope walls such as those used in a bulk storage facility.

SUMMARY OF THE INVENTION

It is, therefore, a general object of the present invention to overcome problems associated with the prior art construction methods and to provide a novel construction method which substantially shortens the time required for construction of a bulk material storage facility.

It is another object of the present invention to provide a novel slope wall which is fashioned from a plurality of substantially identical wall panels, each panel being attached to a plurality of substantially identical wall panels, each panel being attached to a plurality of reinforcing members that are part of a cohesive internally stabilized mass of particulate material underlying the panels.

It is a further object of the present invention to provide a novel wall panel suitable for use in a wall construction of the type discussed above.

A bulk material storage facility constructed in accordance with the present invention includes a storage slot defined in part by a pair of slope walls which are convergent downwardly toward a longitudinally extending opening of a reclaim conveyor tunnel. The walls are inclined with respect to a horizontal reference plane in such a manner that the angle of the wall with respect to the horizontal plane exceeds the angle of repose of the bulk material to be sorted. With the wall angle exceeding the angle of repose, essentially all material in the facility will tend to move toward the longitudinal opening.

Each wall is fashioned from a plurality of wall panels which are generally rectangular in frontal elevation and which may be positioned in horizontal rows such that the panels exhibit a conventional running bond pattern familiar in masonry walls. Thus, the required level of skill in workmen constructing the wall is not unduly high.

By fabricating each wall panel from precast concrete, quality control is possible that has not heretofore been available in slope walls and bulk material storage facilities. Moreover, the actual number of wall panels required for any given project is known in advance with the result that cost can be closely estimated. In addition, the thickness of the concrete facing of the slope wall is determined so that the risk of thin weakened areas in the wall is essentially eliminated.

In accordance with the construction method, as each horizontal row of wall panels is positioned, connected to the reinforcing members, and backfilled, that horizontal row is completed and requires no further surface treatment or dressing. Accordingly, no debris from cutting and the like is generated which would drop down the inclined wall face to delay work in the reclaim tunnel.

When a horizontal row of wall panels have been backfilled with suitable conventional particulate material, the corresponding wall is complete to that elevation. Accordingly, erosion of a prepared surface during winter is not a problem and need not be corrected before proceeding with wall erection.

Each wall panel may be connected to a plurality of longitudinally extending flexible, reinforcing members which extend away from the inclined wall into the particulate material. The wall panels provide an impact facing to protect the underlying material from damage by bulk material dropped into the storage slot.

By surrounding each of the plurality of reinforcing members by the particulate material, the particulate material and the reinforcing members create a cohesive mass which faces and stabilizes the underlying material. Preferably, two sets of reinforcing members are provided at laterally spaced attachment regions on the wall panel, the members of each set being vertically spaced and the vertically spaced members defining generally horizontal planar arrays of parallel members. With the wall panels providing impact protection and the reinforcing members and particulate material stabilizing the underlying material, an inclined wall at a substantial angle is extremely durable.

To further enhance the stability of the wall panels, an interlocking relationship between the individual panels is employed in each slope wall. For this purpose, each wall panel is provided with a tongue which extends from each of its edge surfaces. Adjacent each tongue is a corresponding rabbet. The tongue of one panel is received in the adjacent corresponding rabbet of an adjacent wall panel. In this manner, the tongue and rabbet cooperate to effect an interlocking relationship between the various wall panels.

DESCRIPTION OF THE DRAWINGS

The above and many other objects and advantages will be apparent to those skilled in the art when this specification is read in conjunction with the attached drawings wherein like reference numerals have been applied to like elements and wherein.

DESCRIPTION OF THE PREFERRED EMBODIMENT

Figure 1:
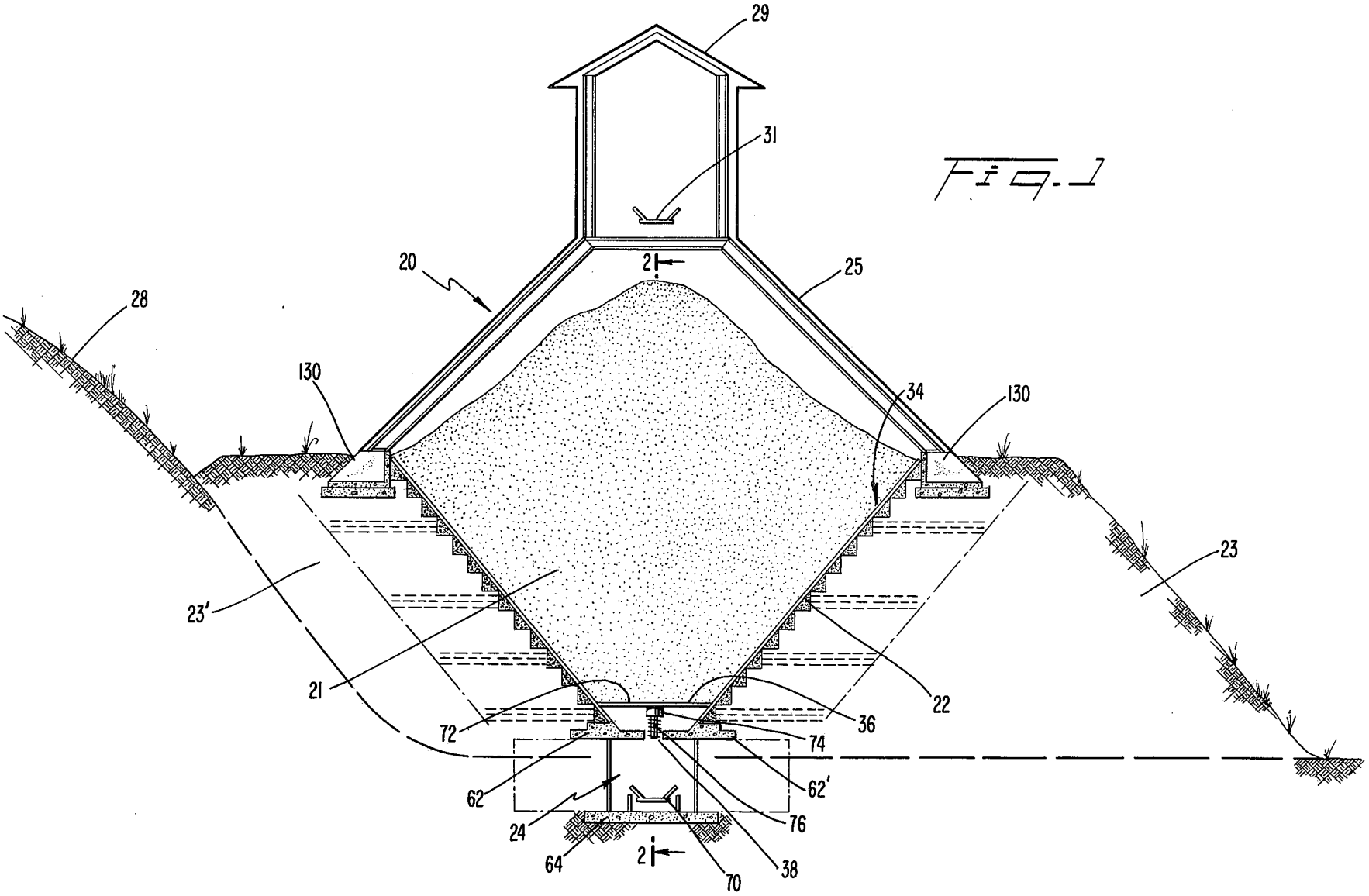
FIG. 1 is a partial cross-sectional view through a bulk storage facility.

Turning now to FIG. 1, there is shown a bulk storage facility 20 for pulverulent granular or fungible friable material 21 such as coal, mineral ores, grain and the like. The facility includes a large V-shaped storage slot 22 or trough which may extend below the existing ground surface 28 or may be defined by one or more parallel dikes 23. If the local terrain contour permits, one side of the storage slot 22 may be built by extending a partial dike 23' from an adjacent hillside. The storage slot 22 of a bulk storage facility 20 may have dimensions such as a length in the range of 250 to 1,000 feet, a depth in the range of 50 to 100 feet and inclined walls at an angle in the range of 45° to 60° with a horizontal reference plane. A storage facility of these general dimensions would be suitable for storing in the neighborhood of 25,000 to 100,000 tons of bulk material.

Figure 2:
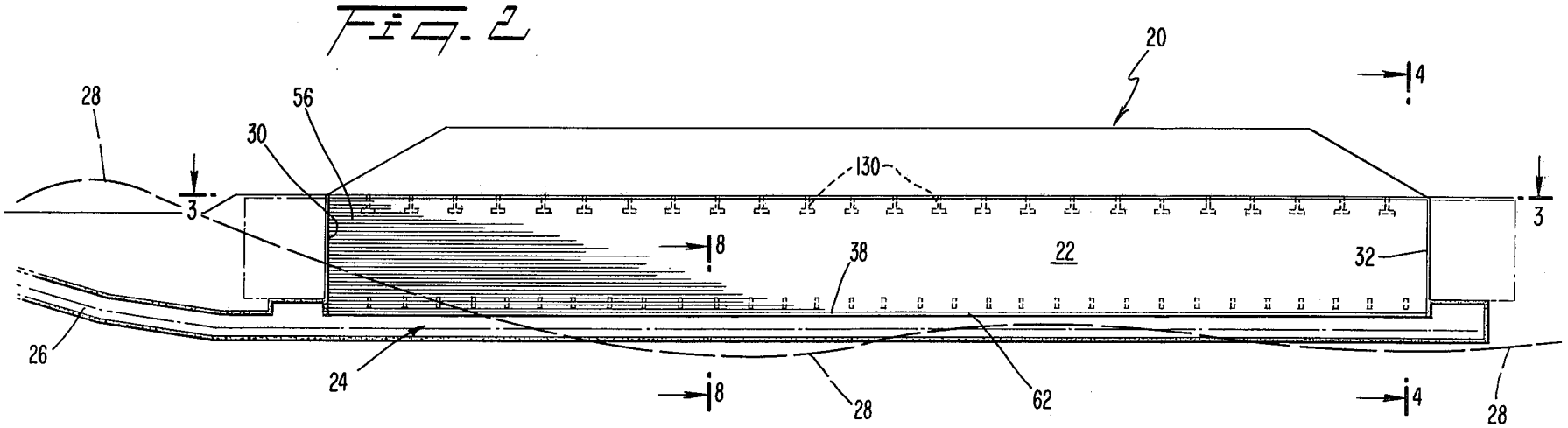
FIG. 2 is a reduced scale partial cross-sectional view taken along the line 2—2 of FIG. 1 with the roof removed for clarity.

At the bottom of the storage slot 22 (see FIG. 2) is a longitudinally extending reclaim conveyor tunnel 24 through which the bulk material is removed for use. The reclaim conveyor tunnel 24 extends throughout the entire length of the facility 20 and includes an inclined portion 26 which extends at least to the ground surface 28. The reclaim conveyor tunnel 24 is adapted to receive an endless conveyor and necessary support machinery. The bulk material drops onto the endless conveyor when agitated by vibrating screens or by a plow having rotary augers thereon.

At the top of the storage slot 22, a roof 25 (see FIG. 1) is provided to protect the bulk material from environmental moisture. The roof has an A-shaped cross-section and is supported by a plurality of footings 30 which are cast in position near the top of the dikes 23, 23'. At the top of the roof, generally at the apex of the cross-section, is a stocking conveyor tunnel 29 within which a suitable conventional tripper conveyor 31 is mounted. The stocking conveyor 31 extends longitudinally of the storage facility 20 and distributes bulk material horizontally before dropping it into the storage slot 22.

The storage slot 22 (see FIG. 3) is defined by a first generally vertical end wall 30, a second generally vertical end wall 32, a first inclined side wall 34 and a second inclined side wall 36. The end walls 30, 32 may be generally planar and may be essentially parallel as illustrated. In addition, the end walls 30, 32 may also be inclined and semicircular in plan view. The inclined side walls 34, 36 are generally planar and converge in a vertically downward direction toward a longitudinal opening 38. The opening 38 is centrally positioned with respect to the end walls 30, 32 and between the side walls 34, 36. The slot 38 extends through the top wall of the reclaim conveyor tunnel 24 and defines an opening through which bulk material may fall onto the endless conveyor when agitated.

As the end walls 30, 32 are similar in construction, it will suffice to describe one end wall in detail. Each of the end walls 30, 32 (see FIG. 4) is preferably fabricated from a plurality of generally square facing elements 40 each of which is provided with a pair of laterally extending arms 42. The arms 42 are adapted to cooperate with the arms of adjacent wall panels and to effect connection therebetween. The specific details of the facing elements 40 are given by United States Letters Patent No. 3,686,873, which issued to Henri Vidal on Aug. 26, 1972, the content of which is incorporated herein in its entirety by this reference thereto.

This wall facing elements 40 of the end wall 32 (see FIG. 5) define an essentially vertical surface held in place by an internally stabilized earth structure 41. This structure is defined by a plurality of elongated metal reinforcing strips or elements 44 connected to the facing elements, extending in planar generally horizontal arrays away from the facing elements into a volume of suitable particulate material 46. The particulate material 46 may, for example, be sand, earth, crushed stone, overburden material or any other locally available material. Friction between particles of the particulate material layers sandwiched or intercalated among the planar horizontal arrays of reinforcing elements 44 stabilizes the particulate material so that a generally vertical wall 32 of the wall facing elements 40 may be provided.

Each reinforcing element 44 may be fabricated of steel and is flexible so as to assume any contour irregularities in the particulate material layers above and below the horizontal array in which the particular element 44 is located.

As the wall 32 is being built, each element 44 is attached to a corresponding facing element 40 and is positioned in a generally horizontal planar array which is subsequently covered by a layer of particulate material. Thereafter, another substantially horizontal planar array of reinforcing elements 44 is attached to the facing elements 40 and positioned on top of the particulate material layer. Additional reinforcing element arrays and particulate material layers are sequentially added with additional horizontal rows of wall facing elements being applied as required. The endwall face is thus completed as this backfilling and wall erection operation proceeds.

Figures 4, 5:
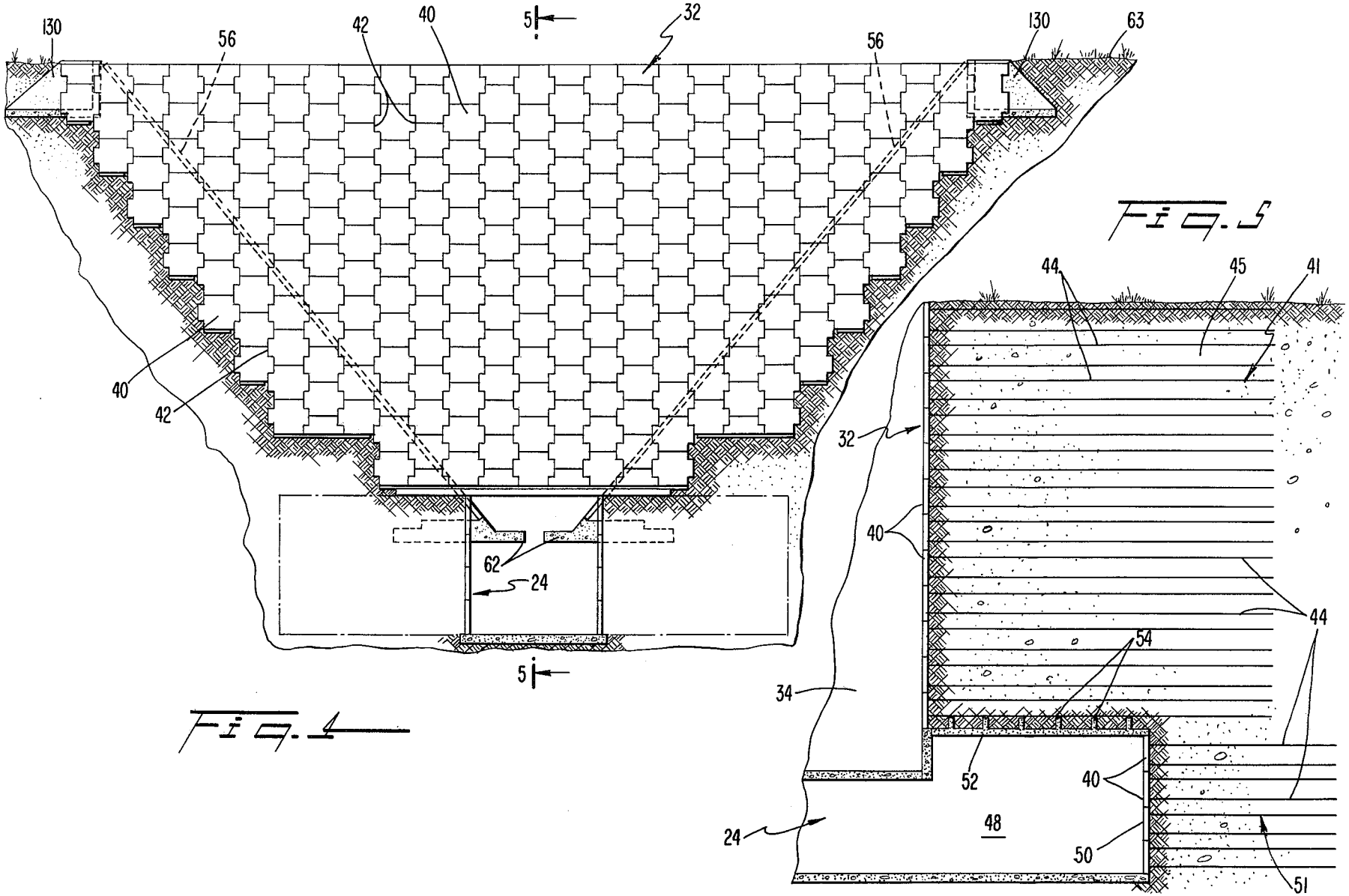
FIG. 4 is an enlarged partial elevational view taken along the line 4—4 of FIG. 2 with the bulk material removed to schematically illustrate an end wall of the facility.
FIG. 5 is a partial cross-sectional view taken along the line 5—5 of FIG. 4 to illustrate the reinforcement members of the end wall panel members.

It will be noted from FIG. 5 that the end wall 32 is positioned above a cavity 48 disposed at one end of the reclaim conveyor tunnel 24. The cavity may be used for conveyor maintenance and repair. The cavity end wall 50 is an internally stabilized earth structure 51 also fashioned from a plurality of wall facing elements 40 with reinforcing members 44 surrounded by particulate material as described above in connection with the end wall 32. The cavity 48 defines an enlarged repair room in which work on the endless conveyor may be performed without danger to workmen from bulk material dropping onto the endless conveyor from the storage facility.

The roof 52 of the cavity 48 is preferably fashioned from concrete with suitable reinforcing ribs 54. The roof 52 may define part of the foundation on which the end wall 32 is constructed.

Figure 6:
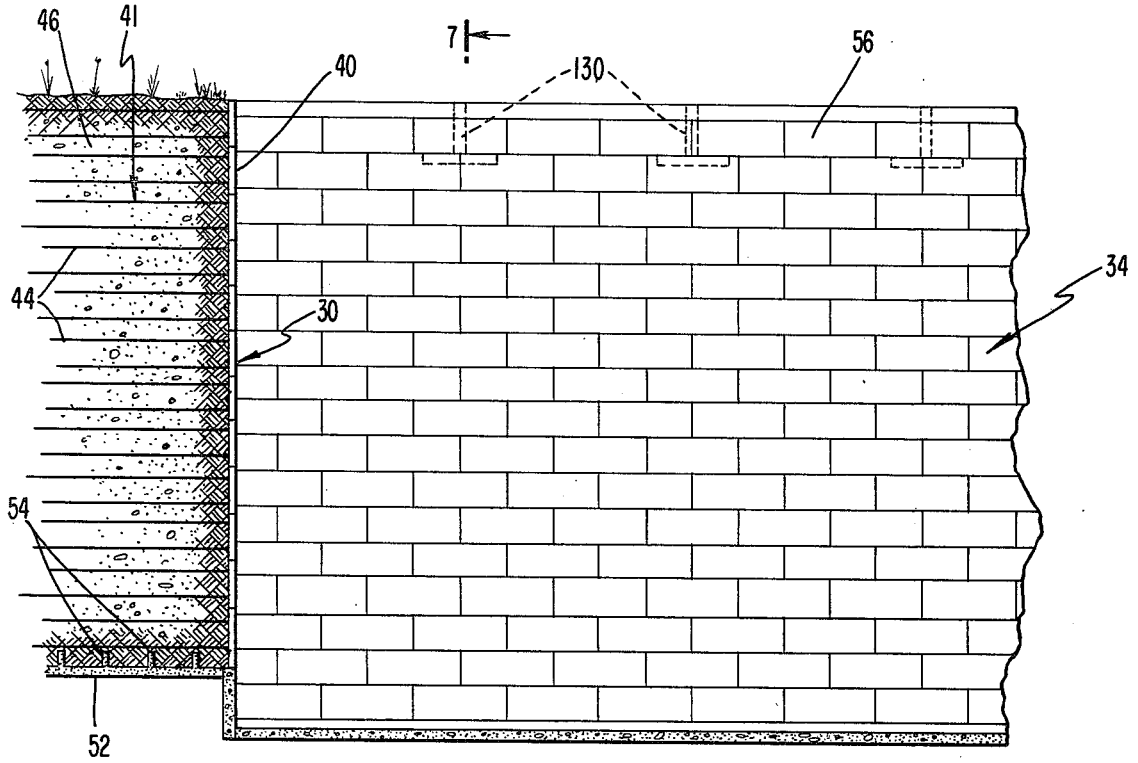
FIG. 6 is an enlarged partial elevational view of the slope wall face taken along the line 6—6 of FIG. 3.

Each of the inclined slope walls 34, 36 (see FIG. 6) is fashioned from a plurality of generally rectangular concrete wall panels 56 that are assembled in a pattern resembling the conventional running course pattern used in masonry walls. Since the construction of both the inclined walls 34, 36 is identical, it will suffice to describe in detail only one of the inclined slope walls 34.

Figure 7:
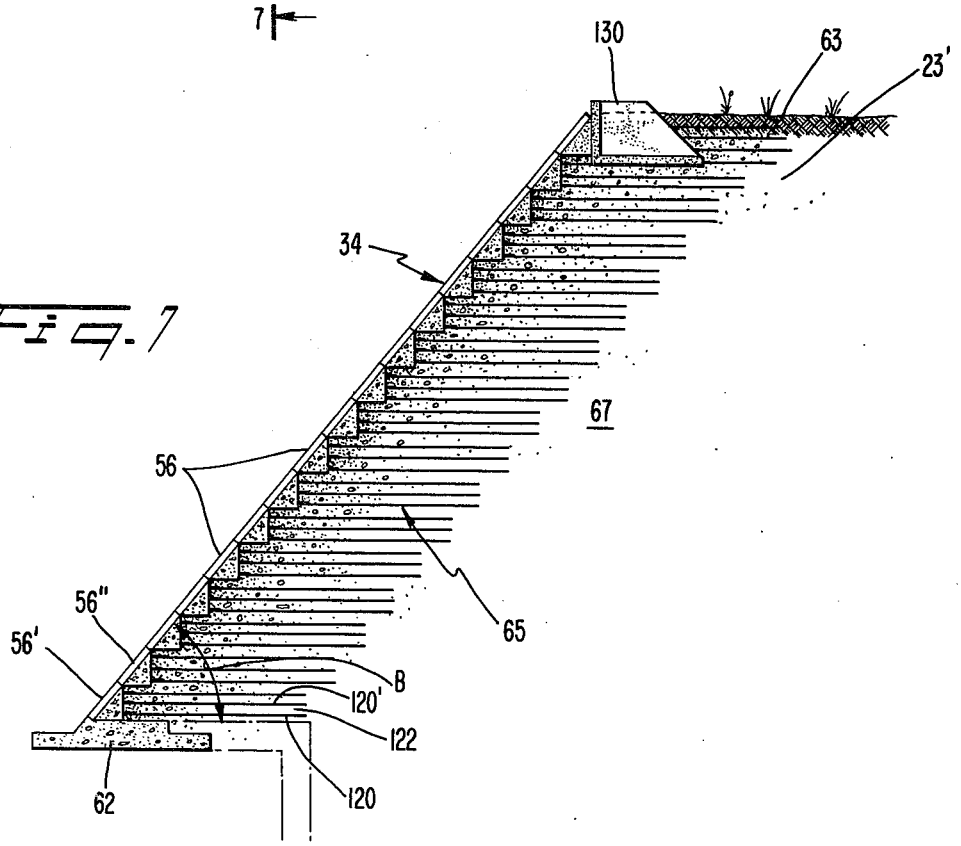
FIG. 7 is a partial cross-sectional view taken along the line 7—7 of FIG. 6 illustrating the reinforcing members of wall panels of the inclined wall.

The wall 34 (see FIG. 7) is inclined at an angle $\beta$ which exceeds the angle of repose of the bulk material to be stored in the facility. With coal, for example, the angle would be in the neighborhood of 45° to 60°. By selecting an angle exceeding the angle of repose, the bulk material will move downwardly along the inclined side walls and will not have any significant volumes from which the pulverulent material will not move under the influence of gravity. This feature is particularly important for coal as coal dust is susceptible to spontaneous combustion.

Figure 8:
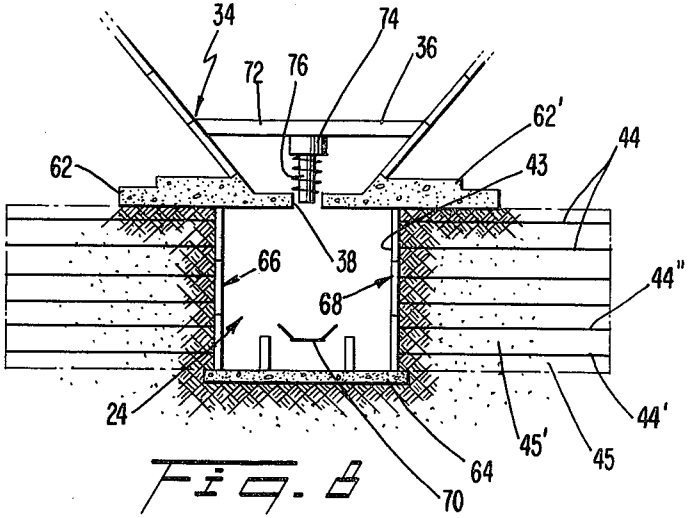
FIG. 8 is an enlarged partial cross-sectional view taken along the line 8—8 of FIG. 2 to illustrate the reclaim conveyor tunnel construction details and the means for dislodging pulverulent material onto the conveyor.

The inclined wall 34 extends upwardly from a cast concrete shelf 62 or a suitable levelling footing to the top 63 of the adjacent dike. As may be seen from FIG. 8, a shelf 62, 62' extends from each side of the reclaim conveyor tunnel 24 and the shelves 62, 62' cooperate to define the longitudinal opening and the roof of the reclaim conveyor tunnel 24.

Each side wall 34 includes an internally stabilized earth structure 65 in which reinforcing members 120 are arranged in generally parallel horizontal planar arrays in a particulate material backfill 122. The stabilized earth structure 65 retains and stabilizes the material 67 located therebehind in the dike 23'. This retention is effected even though the dike material exceeds its classical angle of repose. The stabilized earth structure 65 is faced with a plurality of wall facing panels 56 which are connected to the reinforcing members 120. The facing panels 56 provide impact resistance to bulk material during stocking of the bulk material in the facility. The two inclined walls 34, 36 converge toward the reclaim tunnel 24 to funnel bulk material thereto.

The reclaim conveyor tunnel 24 (see FIG. 8) is preferably fashioned with a concrete floor 64 and two side walls 66, 68, each side wall 66, 68 being an internally stabilized earth structure having a plurality of concrete wall facing panels 40 which are of the same size and construction as those used in the fabrication of the end walls 30, 32. In addition, each conveyor side wall 66, 68 also includes a plurality of horizontal planar arrays of reinforcing members 44 similar to those used in accordance with the construction of the end walls 30, 32, the primary distinction being a difference in length.

The internally stabilized earth structures of the conveyor side walls 66, 68 each include a body of particulate material surrounding the reinforcing members 44. The facing elements 40 are connected to the members 44 in a generally vertical posture to define an architectural facing for the structure. Near the floor 64 of the conveyor tunnel 24, a suitable conventional endless conveyor 70 is positioned which extends the entire length of the coal storage facility 20 (see FIG. 2) and which may pass through the inclined portion 26 of the tunnel 24 to the ground surface 28 or a transfer tower above (not shown).

Above the conveyor tunnel 24 and extending between the inclined walls 34, 36 adjacent the concrete shelves 62, 62' may be a plurality of transverse beams 72 for carrying agitation means for loosening bulk material to be reclaimed. For example, the transverse beams may carry a plow 74 having a rotatable auger 76. The plow 74 is moved longitudinally of the facility 20 at the opening 38 to locally break up and mechanically dislodge any transverse bridging of pulverulent bulk material over the opening 38 so that the bulk material can be selectively removed from the facility.

The auger 76 may be generally vertically disposed above the longitudinal opening 38 and may be operable to dislodge bulk material so that the material falls vertically downwardly through the opening 38 onto the endless conveyor 70 for reclaiming transportation and discharge from the reclaim conveyor tunnel 24.

Figure 9:
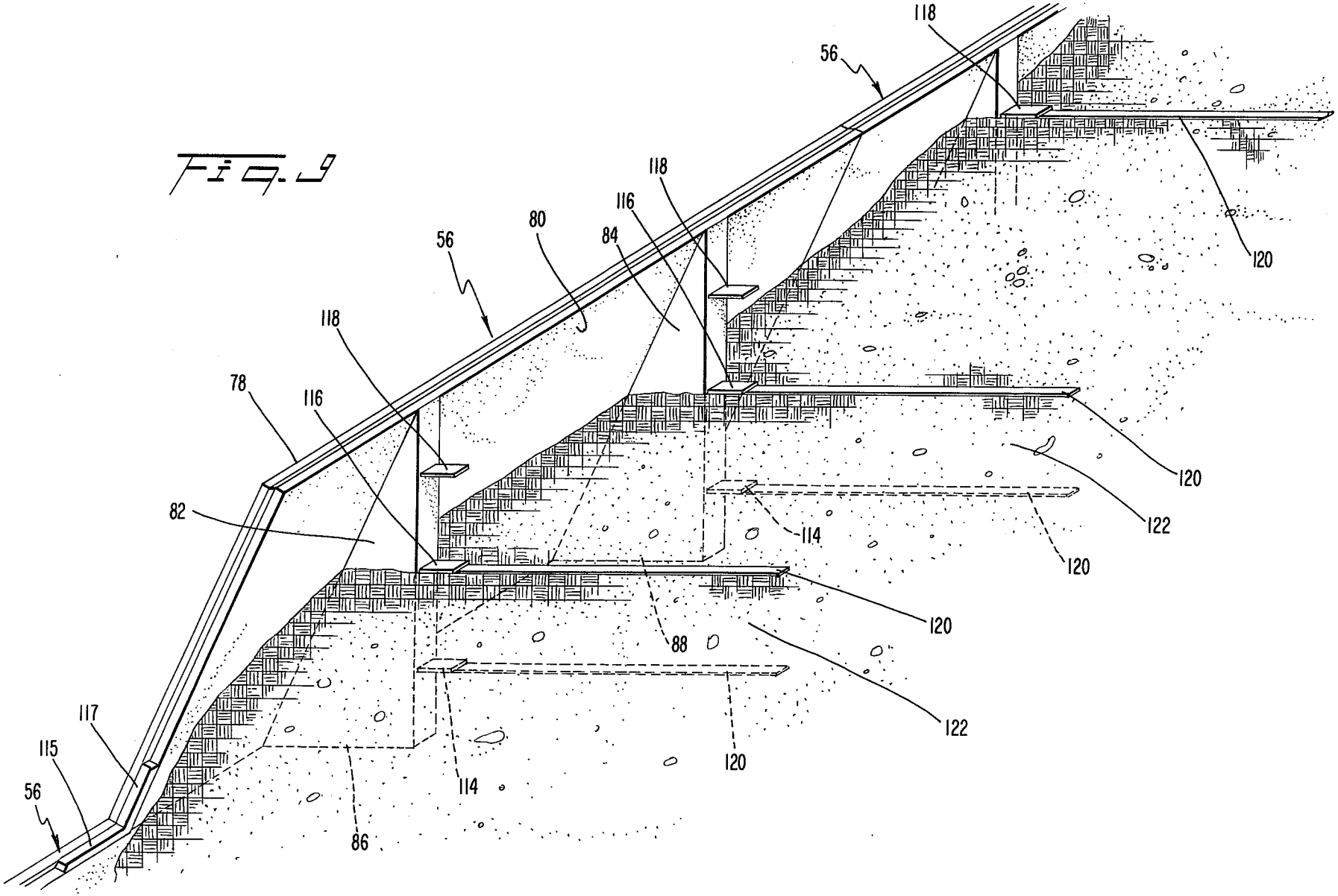
FIG. 9 is a perspective view of a wall panel from the backfill side illustrating gussets and attachment points for reinforcing members.

Returning now to FIG. 7, each inclined wall 34 includes an impact facing fashioned from a plurality of wall facing panels 56 as noted above. Each wall panel 56 (see FIG. 9) includes a front surface 78 and a rear surface 80. The surfaces 78, 80 are generally parallel to give uniform thickness and generally rectangular to facilitate wall assembly from horizontal rows of panels. The rear surface 80 is positioned in contact with the volume of particulate material in the stabilized region behind the inclined wall 34.

A pair of generally triangular gussets 82, 84 project from the rear surface 80 of each wall panel 56 into the particulate material positioned behind the inclined wall 56. The gussets are adapted to support the wall panel during wall erection from the time the wall panel is positioned until the wall panel has been completely backfilled.

Figure 11:
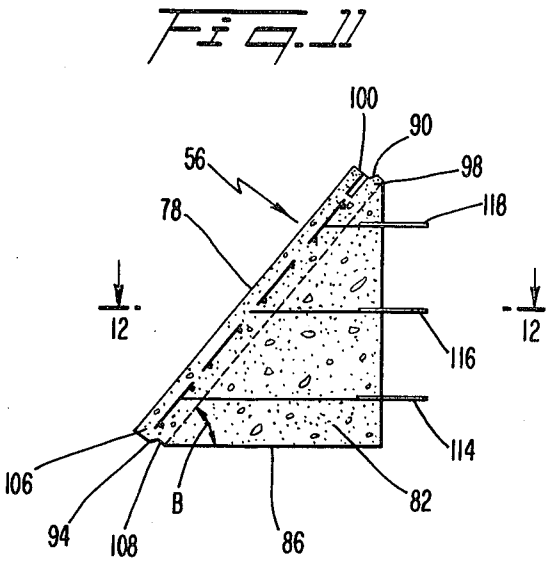
FIG. 11 is a partial cross-sectional view taken along the line 11—11 of FIG. 10.

Each gusset 82, 84 is integrally connected to the wall panel 56 and, for a concrete panel, is monolithic therewith. Each gusset 82, 84 has a corresponding bottom surface 86, 88, respectively, which is generally horizontal. The bottom surfaces are adapted to rest directly on the particulate material that backfills the next lower course of wall panels to thereby support the wall panel 56 in its appropriate inclined relationship with respect to the wall during construction thereof. In this connection, the bottom surfaces 86, 88 of the gusset 82, 84 and the rear face 80 of the wall panel 56 define an angle $\beta$ (see FIG. 11) which corresponds to the predetermined slope angle of the inclined wall.

Figure 10:
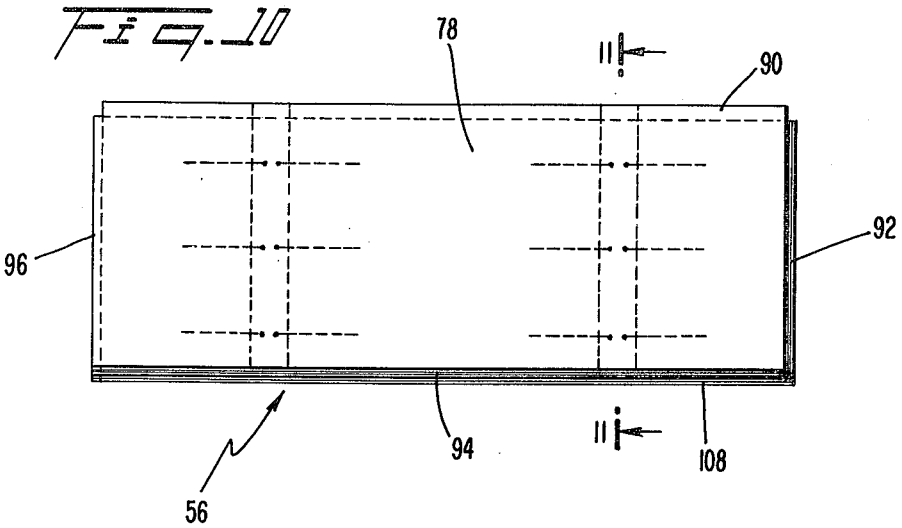
FIG. 10 is an enlarged front elevational view of a wall panel in accordance with the present invention.

Turning now to FIG. 10, the wall panel 56 includes four peripheral edge surfaces 90, 92, 94 and 96. The first edge surface 90 horizontally extends along the top of the panel and includes a tongue 98 adjacent the rear face 80 (see FIG. 11). The first edge surface 90 also includes a rabbet 100 between the tongue and the front face 76. As seen in FIG. 10, the first tongue 98 and the first rabbet 100 extend along the entire length of the wall panel 56.

Figure 12:
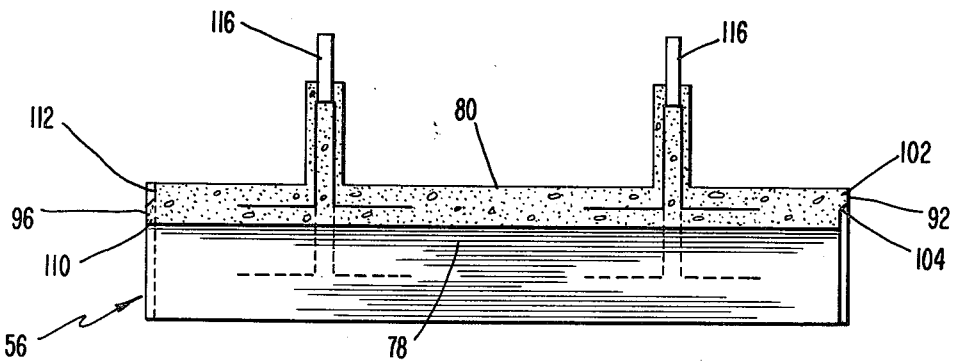
FIG. 12 is a partial cross-sectional view taken along the line 12—12 of FIG. 11 to illustrate the spacing between the gussets.

The second edge surface 92 is generally vertical and (see FIG. 12) includes a second tongue 102 adjacent the rear face 80 and a second rabbet 104 adjacent the front face 78. The second tongue 102 and the second rabbet 104 extend along the entire vertical length of the edge surface 92.

Returning to FIG. 11, the third edge surface 94 extends generally horizontally at the bottom of the wall panel parallel to the first edge surface and includes a third tongue 106 adjacent the front surface 78 and a third rabbet 108 adjacent the rear face 80. From FIG. 10, it will be apparent that the third tongue 106 and the third rabbet 108 extend along the entire lateral width of the wall panel 56. The third tongue 106 (see FIG. 11) is dimensioned to correspond to the first rabbet 100; similarly, the first tongue 90 is dimensioned to conform to the third rabbet 108. In this manner, during wall panels 56 are joined and interlocked such that the front surfaces 78 of the vertically adjacent wall panels are essentially coplanar.

The fourth edge surface 96 (see FIG. 12) is vertical and parallel to the second edge surface 92. The fourth edge surface includes a fourth tongue 110 adjacent the front surface and a fourth rabbet 112 adjacent the rear surface 80. The fourth tongue 110 and the fourth rabbet 112 extend along the entire vertical length of the wall panel 56. In addition, the fourth tongue 110 is dimensioned to conform with the second rabbet 104; similarly, the second tongue 102 is dimensioned to conform to the fourth rabbet 112. Thus, when two panels are horizontally adjacent, the second tongue 102 of one panel is received by the fourth rabbet 112 of the other panel and the fourth tongue 110 of the other panel is received by the second rabbet 102 of the first panel to interlock the horizontally adjacent panels.

The first tongue 98 and the second tongue 102 are preferably sized to be identical and to define one continuous rib; similarly, the third tongue 106 and the fourth tongue 110 are preferably sized to be identical and to define a second continuous rib. The first and second tongues 98, 102 are wider than the third and fourth tongues 106, 110 so that sealing material in strip form 115 (see FIG. 8) can be placed between horizontal edges and sealing material 117 can be placed between adjacent vertical edges of the wall panels. The sealing material is thus concealed.

A wall panel 56 having the edge surfaces configured as discussed above has an interlocking connection with all its adjacent wall panels. More particularly, each wall panel 56 is interlocked against rotation about a substantially vertical axis parallel to the wall by the cooperation of the tongues 102, 110 with rabbets 104, 112 of horizontally adjacent panels that receive respective tongues (see FIG. 12). Similarly, the wall panel 56 is interlocked against rotation about a horizontal axis by virtue of the cooperation between the first tongue 98 and the third tongue 106 with the corresponding rabbets 100, 108 of vertically adjacent wall panels.

Each gusset 82, 84 (see FIG. 9) defines an attachment region for the reinforcing members 120 to be attached to the wall panel. Preferably, there are a plurality, e.g., three or more, attachment points 114, 116, 118 spaced vertically in each attachment region. As illustrated, each attachment point 114, 116, 118 may comprise a short strap extending from the corresponding gusset for connection to a reinforcing member 120. The attachment points 114, 116, 118 may be vertically spaced so that the generally horizontal arrays of reinforcing members are uniformly spaced. In this connection, the uppermost attachment point 118 of one horizontal row of wall panels is spaced from the lowermost attachment point 114 of the next horizontal row by the same distance as the distance existing between attachment points 114 and 116 and attachment points 116 and 118. In this fashion, the layers of particulate material 122 intercalated between the horizontal arrays of reinforcing members have generally uniform thickness.

In addition, the lateral spacing between the gussets 82, 84 is preferably selected so that the gussets 82, 84 are symmetrically positioned. However, the individual reinforcing elements 120 of a given horizontal array need not be uniformly spaced from one another.

In operation, a bulk material storage facility is constructed in accordance with the present invention by selecting and preparing the construction site. If the entire storage slot is to be below the existing ground surface, the unnecessary material must be excavated. If, on the other hand, the storage slot will be defined by parallel dikes, then only excavation for the reclaim tunnel need be performed. For those sites with storage slots partially in excavated regions, appropriate material must be removed.

With the site prepared, the slab 64 (see FIG. 8) which comprises the floor of the reclaim tunnel 24 may be cast in place. Subsequently, the internally stabilized earth side walls 66, 68 of the conveyor tunnel 24 with the facing elements 40 are erected. In this connection, a first course of facing elements 40 is positioned on the slab 64. Thereafter, a layer 45 of particulate material partially backfills the facing elements 40. Then, a first generally horizontal array of reinforcing members 44 is connected to the wall elements 40 and covered with a suitable lift or layer 45' of particulate material.

Subsequently, a second generally horizontal array of flexible reinforcing elements 44'' is connected to the facing elements 40 and covered by a suitable layer of particulate material. Thereafter, another course of facing elements 40 is positioned and the steps of attaching horizontal arrays of reinforcing elements and covering those arrays with a layer of particulate material are repeated until the entire height of the tunnel walls 66, 68 is completed.

With the conveyor tunnel walls completed, the concrete shelves 62, 62' may be cast in place. Each shelf 62, 62' is configured with a portion conforming to the third tongue 106 and the third rabbet 108 of the wall facing panels 56. In this manner, the wall panels 56 also interlock with the shelves 62, 62'.

If desired, the end walls 30, 32 (see FIG. 3) and the inclined side walls 34, 36 may be erected simultaneously so that the facility is essentially complete at each vertical elevation at the same time.

In this connection, the end walls 30, 32 (see FIG. 4) are constructed in the manner described above for the reclaim conveyor tunnel walls 66, 68. For the inclined side walls 34, 36 (see FIG. 7) the first course of wall facing elements 56' is positioned on the precast shelf 62 with the tongue of the shelf received by the third rabbet of each panel. Next, a layer of particulate material 120 is placed which partially backfills the facing elements 56 to a level roughly corresponding to the first attachment points 114 (see FIG. 9). Thereafter, a first generally horizontal array of thin flexible metal reinforcing elements 120 (see FIG. 7) is positioned by attaching one element to each attachment point 114 of each gusset of the wall element 56.

Subsequently, a layer 122 of particulate material is placed to cover the first horizontal array of reinforcing elements 120. Then, a second generally horizontal array of reinforcing elements 120' is connected in like manner to the second attachment points 116 of the gussets of each wall facing panel 56'. The steps of attaching a generally horizontal array of reinforcing elements to the wall panels and covering that array with particulate material are repeated until the first course of panels 56' have been completely backfilled. At this stage, the particulate material behind the first course of panels is generally horizontal and extends about level with the upper edge surfaces.

Next, another horizontal course of wall facing panels 56'' is positioned on the first course of panels 56' such that the vertical joints between panels of the first course 56 are approximately centered with respect to the wall facing panels 56'' of the second course, thus giving rise to a conventional running course pattern typically used in masonry work. When the second course is applied, the sealing material 115 is sandwiched between the adjacent horizontal edge surfaces of wall panels. Similarly, as each wall panel is placed adjacent to another wall panel during positioning of a horizontal course, the sealing material 117 is sandwiched between adjacent panels.

With the second course of wall facing panels 56'' in place, the generally horizontal surfaces of the gussets position the second course 56'' such that the proper inclination of the front face 78 of each wall panel is determined. The second course 56'' is then backfilled to the first set of attachment points. Thereafter, several generally horizontal arrays of reinforcing members are attached to the second course of wall panels 56" alternating with layers of particulate material in the manner discussed above in connection with the first course.

The steps of adding a course of facing panels and then backfilling each course with particulate material and generally horizontal arrays of reinforcing members, continues until the inclined wall 56 has been brought to the ground surface 28 or the top of the dike as the case may be. It will be apparent, that during this time, a canopy can be installed between the two inclined side walls 34,36 to intercept material or debris falling into the storage slot. Accordingly, work can simultaneously be performed in the reclaim tunnel 24. Moreover, to the extent that construction must be halted in winter, the walls are complete, with the facing, and are not susceptible to erosion. Thus, there is no duplication of construction steps to remedy erosion that occurred during the winter.

Figure 3:
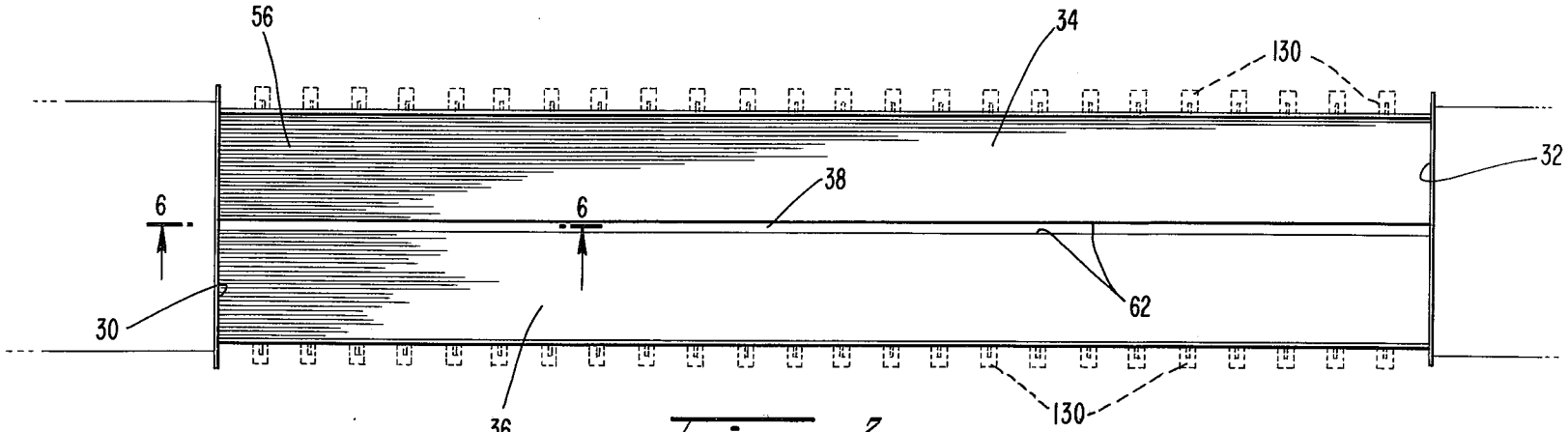
FIG. 3 is a plan view taken along the line 3—3 of FIG. 2 with the bulk material removed for clarity.

When the inclined walls 34, 36 have been completed, a plurality of footers 130 (see FIG. 1) may be positioned adjacent the upper edge of the inclined walls 34, 36 (see FIG. 3). These footers may be positioned at uniformly spaced intervals along the longitudinal length of the storage facility 20 and provide a foundation on which the roof 25 (see FIG. 1) may be erected.

When it is desired to remove bulk material from the storage facility 20 (see FIG. 8) the agitating means 74 is actuated longitudinally of the facility 20. As the plow moves, the auger 76 rotates mechanically dislodging bulk material over the longitudinal opening 38. Accordingly, the bulk material passes vertically downwardly through the opening 38 and drops onto the continuously moving endless conveyor 70. The endless conveyor 70 then moves the bulk material to a transfer station at or above the ground surface by passing through the inclined tunnel portion 26 (see FIG. 2).

It will now be apparent that there has been provided in accordance with this invention a bulk material storage facility which permits the reclaim tunnel to be completed at the same time the walls themselves are being erected. With this feature, it is possible to substantially reduce the length of the time otherwise required to erect the storage facility.

In addition, with a wall constructed from a multiplicity of precast concrete panels the thickness and strength characteristics are known, are uniform and are controlled at a fabrication plant.

With the internally stabilized slope walls, no cement or lime stabilization is required. Therefore, it is not necessary to estimate the quantities of such materials needed. Moreover, the particulate material used in the internally stabilized wall can be any type of locally available material. As the panels are precast, with the required number being a predetermined fixed value, and the amount of reinforcing members known and fixed, the cost of erecting a bulk storage facility can be closely estimated.

Another advantageous aspect of this invention is the substantial reduction in the amount of material that must be handled in comparison to earlier methods. In particular, there is no need to place extra material in the storage slot and later remove it to be sure the wall construction angles would be correct.

While the foregoing description of the erection of an inclined wall proceeds on the basis that the entire length of the wall is erected at the same time and sequence of steps, it is possible that one portion of the wall could be several steps further along than another portion of the wall due to its great length.

It should now be apparent that there has been provided in accordance with the present invention a novel method and apparatus for constructing inclined slope walls for use in pulverulent storage facilities. Moreover, it will be apparent to those skilled in the art that numerous modifications, variations, substitutions and equivalents may be made for features of the present invention without departing from the spirit and scope thereof. Accordingly, it is expressly intended that all such modifications, variations, substitutions and equivalents which fall within the spirit and scope of the invention as defined in the appended claims be embraced thereby.

What is claimed is:

1. In a stabilized earth structure of the type having a facing wall fashioned from a plurality of facing elements, a plurality of reinforcing strips attached to each facing element, and particulate material around the reinforcing strips, wherein the improvement is a wall panel adapted for construction an inclined facing wall comprising:

a generally rectangular panel having a front face, edge surfaces and a rear face adjacent the particulate material;

a gusset integral with the panel, extending from the rear face into the particulate material, having means for attaching each of a plurality of reinforcing strips thereto and including a horizontal edge surface resting on the particulate material which defines an acute angle with the front face; and means extending along the edge surfaces of the panel for cooperating with the corresponding means of an adjacent panel to interlock the panel against rotation about horizontal and vertical axes.

2. The stabilized earth structure of claim 1, wherein the means for cooperating includes:

a first tongue extending along at least part of a first one of the edge surfaces adjacent the rear face and defining a first rabbet adjacent the front face;

a second tongue extending along at least part of a second one of the edge surfaces adjacent the rear face and defining a second rabbet adjacent the front face;

a third tongue extending along at least part of a third one of the edge surfaces adjacent the front face and defining a third rabbet adjacent the rear face, the first and third edge surfaces being generally parallel;

a fourth tongue extending along at least part of a fourth one of the edge surfaces adjacent the front face and defining a fourth rabbet adjacent the rear face, the second and fourth edge surfaces being generally parallel;

so that, in the wall, the first tongue of the panel is received by the third rabbet of one adjacent panel, the second tongue is received by the fourth rabbet of a second adjacent panel, the third tongue is received by the first rabbet of a third adjacent panel, and the fourth tongue is received by the second rabbet of a fourth adjacent panel.

3. The stabilized earth structure of claim 2, wherein:

the first tongue and the second tongue are contiguous; and the third tongue and the fourth tongue are contiguous so as to facilitate assembly of the wall.

4. The stabilized earth structure of claim 1, wherein the panel further includes a second gusset integral with the panel, extending from the rear face into the particulate material, having means for attaching each of a plurality of reinforcing strips thereto, and including a horizontal edge surface, the first and second gussets being spaced from one another so as to be symmetrical to the vertical centerline of the panel.

5. The stabilized earth structure of claim 1, wherein each panel is precast from concrete to assure quality control.

6. An inclined wall presenting a smooth exposed surface, comprising:

a plurality of generally rectangular wall panels arranged in a pattern, each panel having
a smooth front face, edge surfaces, and
a rear face,
a gusset integral with the panel, extending from the rear face away from the smooth front face,
having means for attaching each of a plurality of reinforcing strips thereto and including a horizontal edge surface which defines an acute angle with the front face, and
means extending along the edge surfaces of the panel for cooperating with the corresponding means of an adjacent panel to interlock the panel against rotation about a horizontal and vertical axes;

a plurality of flexible reinforcing members areranged in planar arrays, each reinforcing member being attached to the gusset of a corresponding wall panel and extending away from the rear face, a volume of particulate material surrounding the arrays of reinforcing members, contacting the rear surface, supporting the horizontal edge surface of each wall panel, and cooperating with the reinforcing members to establish a cohesive mass.

7. The inclined wall of claim 6, wherein each wall panel includes a second gusset extending from the rear face into the particulate material and having the arrays of reinforcing members attached thereto.

8. The inclined wall of claim 7, wherein the means for cooperating includes:

a first rib extending along two adjacent edge surfaces, positioned adjacent the rear face, and defining a first groove adjacent the front face; and a second rib extending along two other adjacent edge surfaces, positioned adjacent the front face, and defining a second groove adjacent the rear face, the first rib of one wall panel cooperating with the second groove of an adjacent wall panel and the second rib of the one wall panel cooperating with the first groove of a second adjacent wall panel to interlock the wall panels against relative rotation.

9. The inclined wall of claim 8, wherein:

the second rib is partially received by each of three adjacent wall panels; and the first rib is partially received by each of three more adjacent wall panels, with the plurality of wall panels being arranged in a running bond pattern to enhance the interlocking relationship between individual wall elements.

10. The inclined wall of claim 7, wherein the planar arrays of reinforcing elements are generally uniformly spaced in the vertical direction to enhance internal cohesion of the internally stabilized wall.

11. A storage facility for bulk material comprising:

a pair of spaced apart end walls;

a pair of inclined side walls, convergent in a vertically downward direction, each side wall being inclined relative to a horizontal plane at a predetermined angle exceeding the angle of repose for the bulk material, extending between the pair of endwalls, and including a plurality of generally rectangular wall panels arranged in a pattern, each panel having
a smooth front face, edge surfaces, and
a rear face,
a gusset integral with the panel, extending from the rear face, having means for attaching each of a plurality of reinforcing strips thereto and including a horizontal edge surface which defines the predetermined acute angle with the front face, and
means extending along the edge surfaces of the panel for cooperating with the corresponding means of an adjacent panel to interlock the panel against rotation about a horizontal and vertical axes, a plurality of flexible reinforcing members, each reinforcing member being attached to the gusset of a corresponding wall panel and extending away from the rear face, at least two reinforcing members being provided for each gusset, and a volume of particulate material surrounding the plurality of reinforcing member, contacting the rear surface, supporting the horizontal edge surface of each wall panel and cooperating with the reinforcing members to establish a cohesive mass;

a tunnel extending between the end walls, positioned below the convergent side walls and having a longitudinal opening size to permit bulk material to pass therethrough;

conveyor means in the tunnel for collecting and removing the bulk material;

cover means in the tunnel for collecting and removing the bulk material; and means for agitating the particulate material, positioned above the longitudinal opening to cause movement of the bulk material through the longitudinal opening into the tunnel.

12. The storage facility of claim 11, wherein each of the endwalls is fashioned from a plurality of face elements, a plurality of flexible reinforcing members being connected to each of the face elements and extending in a direction away from the side walls and particulate material surrounding the reinforcing members, the particulate material and the reinforcing members establishing a cohesive mass in which the effective angle of repose is substantially increased.

13. The storage facility of claim 11, wherein sealing material is placed between peripheral edges of adjacent facing elements so as to be concealed.

14. A method of constructing an inclined wall for a bulk material storage facility comprising the steps of:

laying a horizontal course of wall panels on a prepared base, each panel having a front surface inclined relative to the horizontal at an angle exceeding the angle of repose for the bulk material;

attaching planer arrays of reinforcing strips to the panels;

intercalating layers of the particulate material between the planar arrays of reinforcing strips until the top of the horizontal course of wall panels is reached;

positioning the lower edge of a second course of wall panels on the upper edge of the first course of wall panels so that the front surfaces of the first and second courses are coplanar and a horizontal edge surface is supported by the particulate material; and repeating the attaching and intercalating steps.

15. The method of claim 14, further including the step of centering each panel of the second and subsequent courses over a vertical joint of the next course of panels so that a running bond pattern is attained.

16. The method of claim 14, wherein the attaching step includes:

connecting one reinforcing member to each wall panel;

laying the reinforcing member generally horizontal in a direction extending rearwardly from the wall; and positioning the reinforcing members of adjacent wall panels in a generally parallel posture.

17. The method of claim 14, wherein the intercalating step includes:

connecting the reinforcing members of one planar array to the wall panels;

covering the planar array with a layer of particulate material; and repeating the connecting and covering steps for subsequent planar arrays.

* * * * *